US006382917B1

(12) United States Patent
Zuege

(10) Patent No.: US 6,382,917 B1
(45) Date of Patent: May 7, 2002

(54) CEILING FAN HAVING SIDE MOUNTED BLADE IRONS

(75) Inventor: Bradford C. Zuege, Evanston, IL (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/490,638

(22) Filed: Jan. 24, 2000

Related U.S. Application Data

(63) Continuation-in-part of application No. 29/101,390, filed on Mar. 3, 1999, now Pat. No. Des. 419,660, and a continuation-in-part of application No. 29/101,400, filed on Mar. 3, 1999, now Pat. No. Des. 421,113.

(51) Int. Cl.[7] ..... F04D 29/34
(52) U.S. Cl. ..... 416/210 R
(58) Field of Search ..... 416/5, 210 R

(56) References Cited

U.S. PATENT DOCUMENTS

| | | | | | |
|---|---|---|---|---|---|
| 4,391,570 | A | * | 7/1983 | Stutzman | 416/5 X |
| 4,621,977 | A | | 11/1986 | Markwardt | 416/5 |
| 4,640,668 | A | | 2/1987 | Yang | |
| 4,692,096 | A | | 9/1987 | Yang | |
| 4,720,241 | A | | 1/1988 | Markwardt | |
| 4,808,071 | A | | 2/1989 | Chau | |
| 4,878,806 | A | * | 11/1989 | Markwardt | 416/5 |
| 4,900,236 | A | | 2/1990 | Kapaan | 416/208 X |
| 5,077,825 | A | | 12/1991 | Monrose | |
| 5,222,864 | A | | 6/1993 | Pearce | |
| 5,256,037 | A | | 10/1993 | Chatelain | |
| D348,729 | S | | 7/1994 | Mason | |
| 5,332,364 | A | | 7/1994 | Rodarmer | |
| D361,377 | S | | 8/1995 | Tsuji | |
| 5,462,412 | A | | 10/1995 | Scofield et al. | |
| 5,486,094 | A | | 1/1996 | Davis, Jr. et al. | |
| D389,908 | S | | 1/1998 | Dolan | |
| D396,531 | S | | 7/1998 | Lieu | |
| D404,480 | S | | 1/1999 | Liu | |
| 5,873,701 | A | * | 2/1999 | Shiu | 416/5 X |
| 5,899,663 | A | * | 5/1999 | Feder et al. | 416/5 |
| D411,295 | S | | 6/1999 | Evans | |
| D413,165 | S | | 8/1999 | Tsuji | |
| 5,944,487 | A | | 8/1999 | Pearce | |
| 5,967,754 | A | * | 10/1999 | Chou | 416/210 R |
| D417,499 | S | | 12/1999 | Zuege | |
| D419,660 | S | | 1/2000 | Zuege | |
| D421,113 | S | | 2/2000 | Zuege | |
| 6,059,531 | A | * | 5/2000 | Tai | 416/220 A |
| 6,062,820 | A | * | 5/2000 | Wang | 416/210 R |
| 6,149,388 | A | * | 11/2000 | Liao | 416/210 R |

* cited by examiner

*Primary Examiner*—John E. Ryznic
(74) *Attorney, Agent, or Firm*—Baker, Donelson, Bearman & Caldwell

(57) ABSTRACT

A ceiling fan is provided which includes an electric motor having a stator and a rotating portion comprising a rotor and upper and lower end caps, each attached to the rotor. The ceiling fan further includes a rotatable fan housing disposed in surrounding relationship with the electric motor and attached to the rotatable lower end cap of the motor. The rotatable fan housing includes a substantially cylindrical sidewall having an inner surface and an outer, radially outwardly facing surface. The fan further includes a plurality of blade irons and a like number of fan blades, with each of the blade irons being mounted to the radially outwardly facing surface of the rotatable fan housing and each blade being attached to one of the blade irons.

16 Claims, 8 Drawing Sheets

CEILING FAN HAVING SIDE MOUNTED BLADE IRONS

CROSS REFERENCES

This application is a continuation-in-part of U.S. Design patent application Ser. No. 29/101,390 is now U.S. Des. Pat. No. 419,660 entitled "Ceiling Fan and Light Fixture" filed Mar. 3, 1999, which is expressly incorporated by reference herein in its entirety, and is also a continuation-in-part of U.S. Design application Ser. No. 29/101,400 entitled "Ceiling Fan and Light Fixture", filed Mar. 3, 1999 is now U.S. Des. Pat. No. 421,113, which is expressly incorporated by reference herein in its entirety.

BACKGROUND 1.0 Field of the Invention

The present invention relates generally to ceiling fans and, more particularly, to ceiling fans having the blade irons which support the fan blades mounted to a rotatable fan housing.

2.0 Related Art

Ceiling fans include a plurality of fan blades which are rotated by an electric motor to provide a supplementary means of conditioning air within both commercial and residential buildings. Ceiling fans typically include a stationary fan housing, which may include an ornamental exterior design and may assume a wide variety of shapes, disposed in surrounding relationship with the electric motor. Fan housings are sometimes referred to in the art as motor housings. However, it is understood in the art that the primary purpose of fan housings is to obscure the electric motor from view to provide a more aesthetically pleasing appearance to the ceiling fan and it is further understood that the fan housing is not part of the electric motor but instead is a separate component of the ceiling fan. The stationary fan housing is supported by the stationary structure used to suspend the ceiling fan. For instance, with ceiling fans utilizing a downrod and ball arrangement in conjunction with a ceiling mounted canopy to suspend the fan, the stationary fan housing may be attached to an adaptor which is secured to the lower end of the downrod.

The electric motors used in ceiling fans comprise either "standard configuration" or "inside-out" electric motors. With "standard configuration" motors the rotor, which comprises a rotating portion of the motor, is disposed radially inwardly of the stator or stationary portion of the motor which includes the electric windings of the motor. The opposite configuration exists in "inside-out" motors, i.e., the rotor is disposed radially outwardly of the stator. Regardless of the type of electric motor used, it may be appreciated that the fan blades must be connected to and rotatably driven by a rotating portion of the motor to provide the desired rotation of the blades. The rotating portion of an "inside-out" electric motor may include upper and lower end caps or end bells in addition to the rotor.

Various means may be used to mount the fan blades to the rotating portion of an "inside-out" electric motor of a ceiling fan, with one commonly employed mounting arrangement being disclosed in U.S. Pat. No. 5,462,412. As best seen in FIG. 2, each fan blade 20 is fastened to a distal end 66 of a blade iron 62, with the proximal end 64 of each blade iron 62 being fastened to a lower surface 72 of motor 16 via screw 70.

Another commonly employed ceiling fan blade mounting arrangement is disclosed in U.S. Pat. No. 5,222,864. As shown in FIGS. 2 and 3, the radially inner end of each fan blade 20 is mounted to a wedge shaped member 84 disposed on an upper surface 22 of motor 16 via screws 88. It is noted that the fan housings disclosed in each of the foregoing patents (denoted by reference no. 18 in both patents) comprise stationary housings.

U.S. Pat. No. 5,944,487 discloses yet another ceiling fan blade attachment system. As shown in FIG. 1, the disclosed system includes a blade mounting ring 21 which is disposed below and fixedly attached to a motor mounting face 5 of a rotatable, lower motor casing portion 13 of inside-out motor 1 via bolts 17. The blade mounting ring 21 includes a plurality of fan blade mounting brackets 31 which extend outwardly from a substantially cylindrical portion 29 of ring 21. Each of the disclosed fan blades 35 is affixed to the underside of one of the brackets 31 with screws or bolts.

U.S. Design Pat. No. D.361,377 discloses two embodiments of a ceiling fan and light fixture which include a fan housing having stationary upper and lower portions and a rotatable center portion disposed therebetween, with each fan blade passing through slots formed in the center portion of the fan housing at a location near the inner end of the blade. Although not shown in the design patent, it is known in the art that the rotatable center portion of the fan housing is mounted to a rotatable lower portion of the included electric motor. As further known in the art, the radially inner end of each fan blade is attached to a radially outer portion of a blade iron which is attached, at a radially inner end thereof, to the rotatable lower portion of the electric motor.

Known ceiling fans also include those having a rotatable fan housing with a lower portion of the fan housing secured to the lower, rotatable end cap of the electric motor, with these fans further including blade irons attached to a bottom, downwardly facing surface of the lower portion of the fan housing.

With regard to "standard configuration" electric motors, the fan blades may be attached to blade irons which are in turn are attached to a rotating flywheel which is secured to a rotor shaft of the electric motor.

Although each of the foregoing fan blade mounting arrangements have enjoyed widespread use, ceiling fan designers continue to search for alternative fan blade mounting arrangements which provide a different "look" to the ceiling fan and which may provide various advantages associated with the manufacture, shipment, assembly and operation of the ceiling fan.

SUMMARY

In view of the foregoing needs, the present invention is directed to a ceiling fan having a different look which is aesthetically pleasing, and several functional advantages, due to the incorporation of side mounted blade irons. More particularly, the ceiling fan of the present invention includes blade irons which are mounted to a radially outwardly facing surface of a rotatable fan housing, with each fan blade being attached to one of the blade irons. In a preferred embodiment, this surface is an outer surface of a substantially cylindrical sidewall of the housing. Since the blade irons are mounted directly to a side surface of the rotatable motor housing, the blade irons may be smaller than those often used with conventional ceiling fans which are mounted to a bottom portion of the motor and are "looped" to obtain the desired vertical position of the blade iron. Accordingly, the blade irons incorporated by the ceiling fans of the present invention may be cheaper, lighter and have a longer service life due to reduced chance of fatigue, as compared to blade irons typically used with conventional ceiling fans. Further, the mounting position of the blade irons will result in less imbalance and therefore reduced "wobble" during operation of the ceiling fan due to a reduction in manufacturing variations in radial location of the bolt holes used to attach the fan blades to the blade irons. The expected reduction in operational ceiling fan wobble is also due to a variety of additional factors including the following. In the first instance, it is believed that the geometry of the blade irons, which extend radially outwardly from the base attached to the substantially cylindrical sidewall of the rotatable housing, will permit less variation in blade center of gravity and blade pitch angle as compared to ceiling fans incorporating blade irons having more complex geometries, such as the aforementioned "loop" due to attachment to the bottom portion of the motor. As known in the art, variations in blade pitch angle contribute to ceiling fan wobble. Furthermore, the simplified geometry of the blade irons results in substantially radially directed forces, as compared to the complex force vector of conventional blade irons having more complex geometry, which enhances the chance for improved fan balancing and therefore reduces operational wobble. Yet another advantage associated with the ceiling fan of the present invention is associated with the shipment of the fan from the manufacturer's facility. The attachment of the rotatable motor housing to the rotor, via multiple circumferentially spaced fasteners, provides a more rigid structure than that associated with many conventional ceiling fans employing a stationary motor housing attached to a centrally disposed adaptor connected to the stator shaft of the motor. Accordingly, the package used to ship the ceiling fan of the present invention may be simplified relative to that employed with many conventional ceiling fans. The blade mounting arrangement included in the ceiling fan according to the present invention also provides a simple installation of the blade irons, used to support the fan blades, for the end consumer which is considered to be easier than that associated with typical fan blade mounting arrangements of conventional ceiling fans. For instance, with conventional ceiling fans, it is often necessary for the consumer to remove at least a top cover of the ceiling fan switch housing to gain access to the motor surface to which the blade irons are attached.

According to one preferred embodiment the present invention is directed to a ceiling fan comprising a means for suspending the ceiling fan from the ceiling of a structure and an electric motor having a rotating portion and a stator. The rotating portion of the electric motor includes a rotor, an upper end cap and a lower end cap, with the upper and lower end caps being attached to the rotor. The stator includes a stator shaft connected to the means for suspending the ceiling fan. The means for suspending the ceiling fan may include a hollow canopy which includes a seat and may be mounted to the ceiling of the structure via a bracket, a downrod, an adaptor secured to a lower end of the downrod, and a ball secured to an upper end of the downrod and disposed within the seat of the canopy. The adaptor may include a radially extending flange portion and upper and lower substantially cylindrical portions, with the upper substantially cylindrical portion being secured to the downrod and the lower substantially cylindrical portion of the adaptor being secured to the stator shaft.

The electric motor may comprise an inside-out electric motor wherein the rotor of rotating portion of the motor is disposed radially outwardly of the stator. However, in other embodiments, the motor may comprise a standard configuration electric motor, i.e., one in which the rotor is disposed radially inwardly of the stator.

The ceiling fan further comprises a rotatable fan housing disposed in surrounding relationship with the electric motor, with the rotatable fan housing being attached to the rotating portion of the electric motor. In one preferred embodiment, the rotatable fan housing is attached to a bottom surface of the lower end cap of the rotating portion of the motor. The ceiling fan may include a plurality of resilient grommets, each having an upper portion disposed between the electric motor and the rotatable fan housing, which act as vibration isolators or dampeners. The rotatable fan housing includes a radially outwardly facing surface which may have a substantially cylindrical shape.

The ceiling fan further includes a plurality of blade irons, and a like number of fan blades, with each of the blade irons being mounted to and protruding outwardly from the radially outwardly facing surface of the rotatable fan housing. Each of the fan blades includes a radially outer and a radially inner end, with the radially inner end being supported by one of the blade irons. Each of the blade irons include a circumferentially extending base, which is mounted to the radially outwardly facing surface of the rotatable fan housing, and a radially outwardly extending blade supporting portion. Each blade iron may also include a connecting portion interconnecting the base and blade supporting portion. The base, blade supporting portion and connecting portion are preferably made as an integral casting. The blade supporting portion may include a plurality of internally threaded bosses for the purpose of fastening the radially inner ends of the blades to the blade supporting portions of the blade irons.

The ceiling fan may further include a stationary fan housing which is attached to the means for suspending the ceiling fan. In one embodiment, the stationary fan housing is attached to the radially extending flange portion of the adaptor included in the means for suspending the ceiling fan.

BRIEF DESCRIPTION OF THE DRAWINGS

These and other features, aspects, and advantages of the present invention will become better understood with regard to the following description, appended claims and accompanying drawings, wherein:

DETAILED DESCRIPTION

Figure 1:
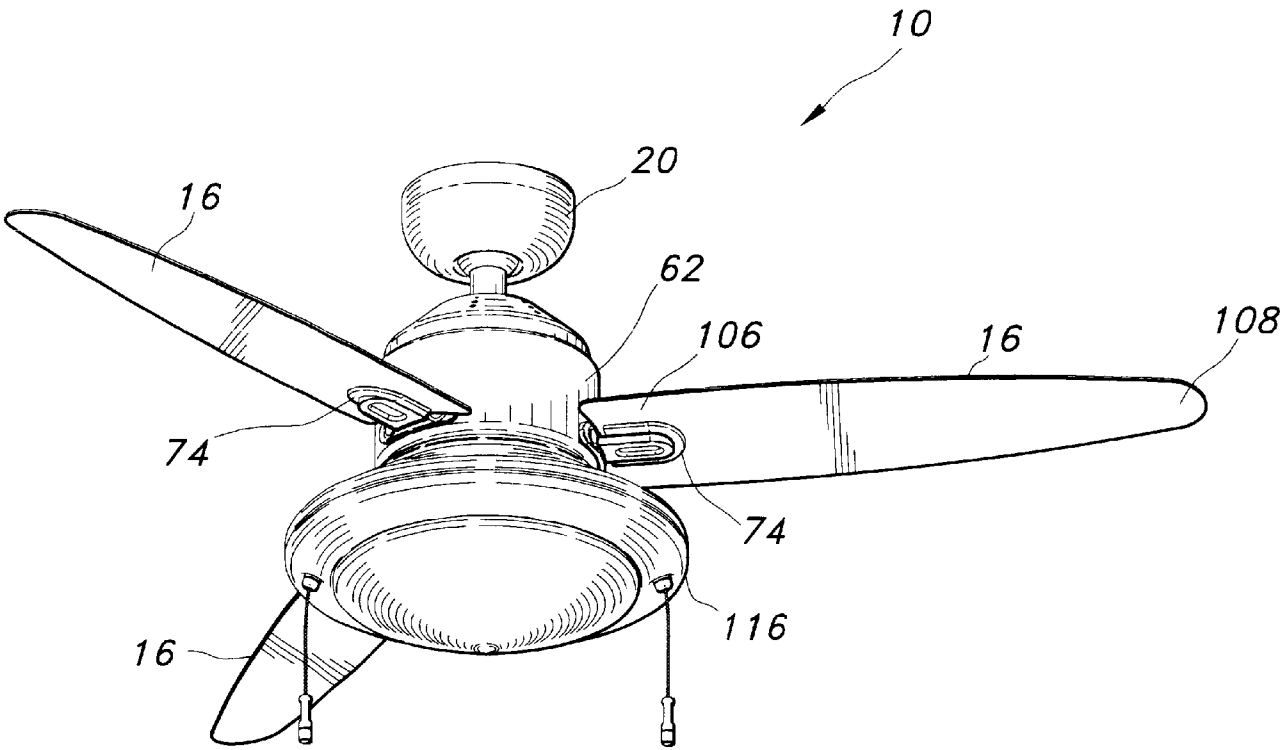
FIG. 1 is a perspective view illustrating a ceiling fan according to the present invention.
Figure 2:
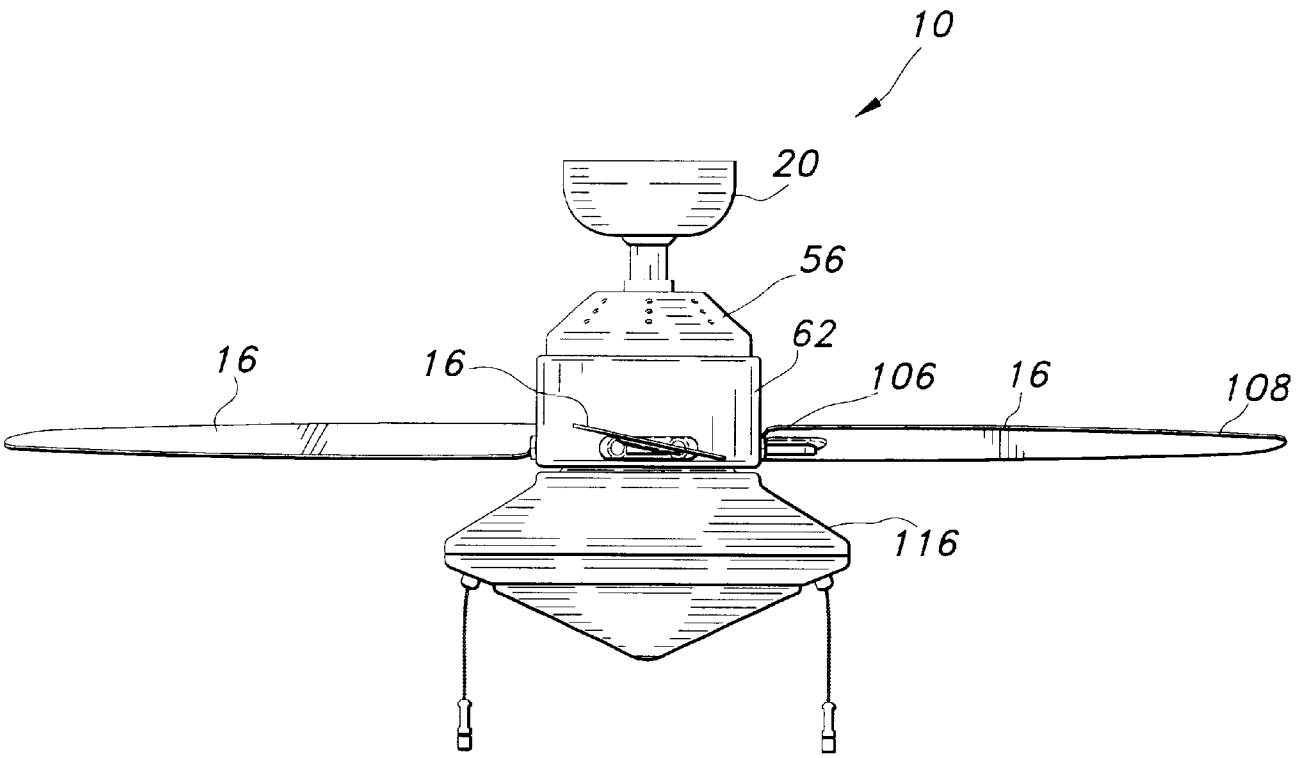
FIG. 2 is an elevational view of the ceiling fan shown in FIG. 1.
Figure 3:
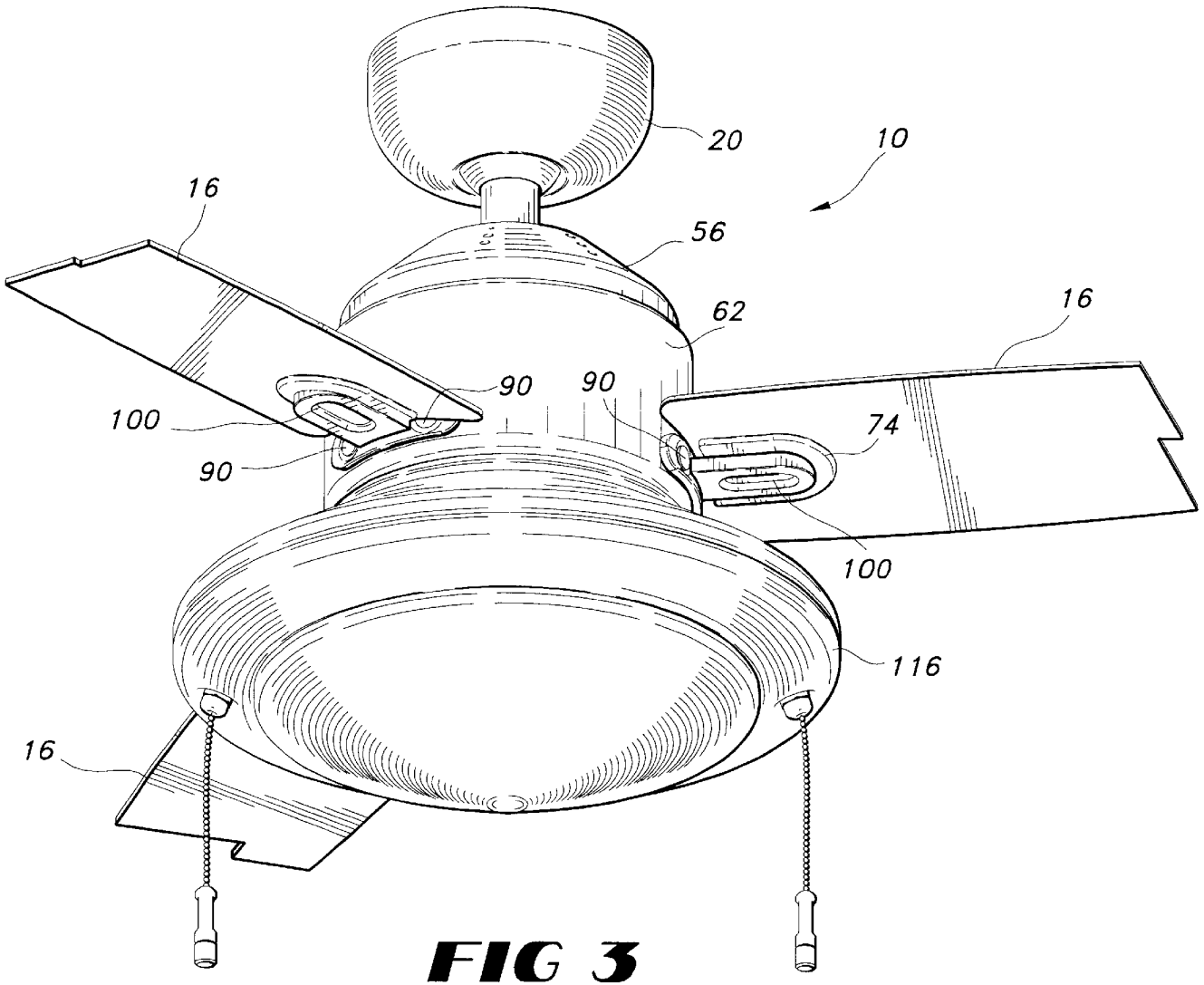
FIG. 3 is an enlarged, perspective view of the ceiling fan shown in FIG. 1, with the included fan blades being shown in fragmentary view.
Figure 4A:
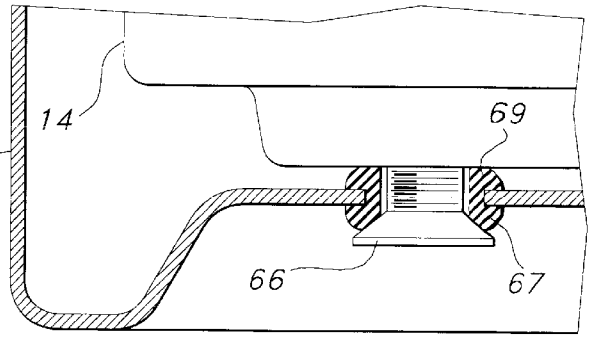
FIG. 4A is an enlarged, fragmentary, cross-sectional view corresponding to a portion of the cross-sectional view shown in FIG. 4.
Figure 4:
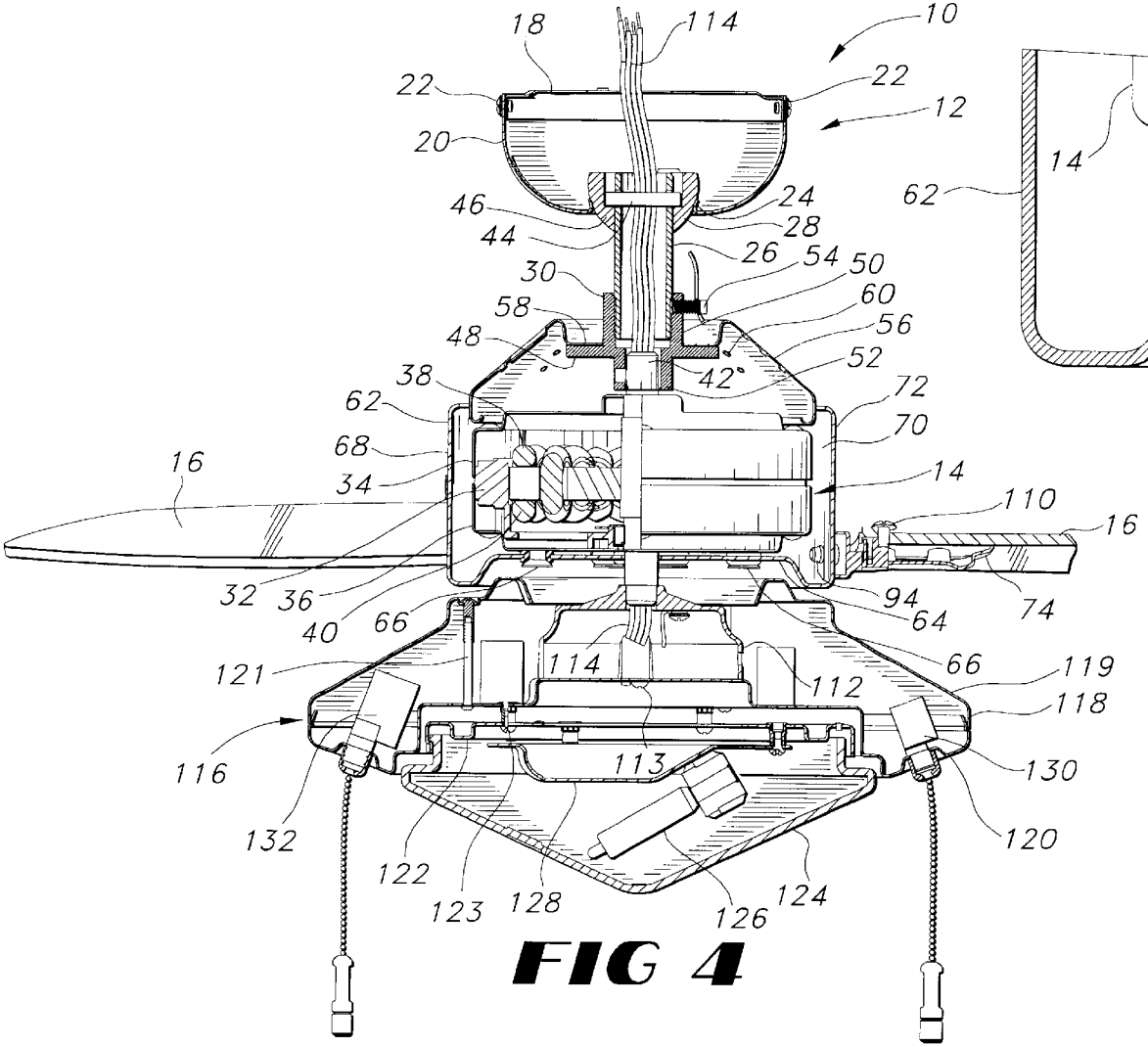
FIG. 4 is a cross-sectional view further illustrating the ceiling fan shown in FIGS. 1–3.

Referring now to the drawings, wherein like reference numerals have been used for similar elements throughout, FIG. 1 is a perspective view illustrating a ceiling fan 10 according to the present invention, and FIGS. 2–4 are elevational, enlarged perspective and cross-sectional views, respectively, of ceiling fan 10. Ceiling fan 10 includes a means, indicated generally at 12, for suspending the fan 10 from the ceiling (not shown) of a residential or commercial structure, an electric motor 14 which is connected to and supported by the means 12 for suspending the fan 10, and a plurality of fan blades 16 which are rotatably driven by the electric motor 14 to provide a supplemental means of conditioning the air within the residential or commercial structure. In the illustrative embodiment, the means 12 for suspending the ceiling fan 10 includes a bracket 18 which may be attached directly to the ceiling of the structure via fasteners in a manner which is known in the art and a hollow canopy 20 which is attached to the bracket 18 via fasteners 22. As shown in FIG. 4, the canopy 20 includes a seat 24 formed in a lower end thereof The means 12 for suspending the ceiling fan 10 further includes a downrod 26, a ball 28 and an adaptor 30 which are interconnected as subsequently described.

The electric motor 14 includes a rotating portion comprising a rotor 32, an upper end cap or end bell 34, and a lower end cap or end bell 36. Each of the end caps 34 and 36 are attached to the rotor 32, by a plurality of fasteners (not shown) as known in the art. The electric motor 14 further includes a stationary stator 38 which includes electrical stator windings 40 and a stator shaft 42. In the illustrative embodiment, electric motor 14 comprises an inside-out electric motor since the rotor 32 is disposed radially outwardly of the stator 38. However, it should be understood that the ceiling fan 10 of the present invention may be used in conjunction with standard configuration electric motors, i.e., those in which the stator is disposed radially outwardly of the rotor, as subsequently discussed in greater detail.

As shown in FIG. 4, the ball 28 is secured to an upper end of the downrod 26 via a pin 44 and is disposed within the seat 24 of canopy 20. The pin 44 engages a shoulder 46 formed in the interior of ball 28 when fan 10 is in an installed position due to the vertical loads exerted on the downrod 26 when fan 10 is attached. An outer surface of the ball 28 and an inner surface of the seat 24 of canopy 20 have mating shapes to permit the ceiling fan 10 to pivot about ball 28 and seat 24 to accommodate a vaulted or sloped ceiling. For instance, as known in the art, the ball 28 may have a hemispherical outer surface and the inner surface of canopy seat 24 may be shaped to match.

As shown in FIG. 4, the adaptor 30 includes a radially extending flange portion 48 and upper 50 and lower 52 substantially cylindrical portions, each having internal threads. The lower end of the downrod 26 is secured to the upper, substantially cylindrical portion 50 of the adaptor 30, by threading the lower end of the downrod 26 into the substantially cylindrical portion 50, and may be further secured by one or more set screws 54 which pass through the substantially cylindrical portion 50 and press against the lower end of the downrod 26. The upper end of the stator shaft 42 of the electric motor 14 is secured to the lower, substantially cylindrical portion 52 of adaptor 30 by threading the upper end of the stator shaft 42 into the substantially cylindrical portion 52. The upper end of the stator shaft 42 may be further secured to portion 52 by one or more set screws (not shown) passing through portion 52 into contacting engagement with the upper end of the stator shaft 42. In the foregoing manner, the means 12 for suspending the ceiling fan 10 provides support to the electric motor 14 and the remainder of the ceiling fan 10.

Ceiling fan 10 further includes a stationary fan housing 56 having an upper flange portion 58 which is attached to the flange portion 48 of the adaptor 30 by a plurality of fasteners (not shown), thereby securing the stationary fan housing 56 to the adaptor 30. The fan housing 56 may comprise a variety of shapes and the outer surface of the fan housing 56 may include an ornamental design. The stationary fan housing 56 further includes a plurality of apertures 60 formed therethrough for the purpose of dissipating heat created by motor 14 during the operation of the ceiling fan 10. In the illustrative embodiment, the apertures 60 comprise circular holes which are arranged in a plurality of circumferentially spaced columns. However, in other embodiments, the apertures 60 may have a variety of other shapes and be arranged in a different manner. The shape and arrangement of apertures 60 may add to the ornamental design of the stationary fan housing 56.

Ceiling fan 10 further includes a hollow, rotatable fan housing 62 which is disposed in surrounding relationship with the electric motor 14 and is connected to a rotating portion of the motor 14, for rotation therewith. More particularly, in the illustrative embodiment, the rotatable fan housing 62 includes a lower flange portion 64 which is attached to the lower end cap 36 of the electric motor 14 via a plurality of conventional fasteners, such as screws 66. In a preferred embodiment, a grommet 67 is used in conjunction with each screw 66. Grommets 67 are made of a resilient material such as rubber, and act as vibration isolators or dampeners. In the illustrative embodiment, the rotatable fan housing 62 is directly connected to the rotating portion of motor 14 due to the attachment, or fastening, of flange portion 64 to the lower end cap 36. However, in other embodiments, when the electric motor of fan 10 comprises a standard configuration electric motor, i.e., one in which the stator is disposed radially outwardly of the rotor, the included rotatable fan housing may be attached to a rotatable flywheel which is connected to a rotating shaft of the motor, thereby providing indirect connection of the rotatable fan housing to the electric motor.

As best seen in the enlarged view shown in FIG. 4A, each grommet 67 includes an upper portion 69 disposed between the lower end cap 36 and the rotatable fan housing 62, thereby dampening the vibrations transmitted from motor 14 to housing 62 and blades 16. Each grommet 67 passes through a hole in fan housing 62, includes an annular notch to accept fan housing 62, and further includes a centrally disposed opening passing therethrough to receive one of the screws 66. In the illustrative embodiment, fan 10 includes four of the screws 66 and vibration isolation grommets 67, although other quantities may be used, which results in a reduction of parts relative to conventional ceiling fans which often incorporate vibration isolators in conjunction with each fastener used to attach the fan blades to the blade irons. For instance, if three fasteners and vibration isolators are used to mount each blade, and the fan includes three blades, a total of nine vibration isolators would be required compared to the four grommets 67 of fan 10.

The fan housing 62 further includes a substantially cylindrical sidewall 68 which is radially spaced from the electric motor 14 and includes an inner surface 70 and an outer surface 72, each having a substantially cylindrical shape, with surface 72 comprising a radially outwardly facing surface.

Ceiling fan 10 further includes a plurality of blade irons 74, with each being mounted to and protruding outwardly from the radially outwardly facing surface 72 of the rotatable fan housing 62. In the illustrative embodiment, ceiling fan 10 includes three blade irons 74 and three fan blades 16. However, in other embodiments, ceiling fan 10 may incorporate a different number of blade irons 74 and fan blades 16, provided a like number of blade irons 74 and fan blades 16 are provided. As best seen in FIGS. 5–9, which illustrate a single blade iron 74, each of the blade irons 74 includes a circumferentially extending base 76, a radially outwardly extending blade supporting portion 78 and a connecting portion 80 which extends between and interconnects the base 76 and blade supporting portion 78. In a preferred embodiment, base 76, blade supporting portion 78 and connecting portion 80 are made as a one piece, integral casting. In other embodiments, the connecting portion 80 may be eliminated, such that the blade supporting portion abuts the base and protrudes radially outwardly therefrom.

The circumferentially extending base 76 has an elongated shape and is hollow for weight savings purposes. Base 76 includes inner 82 and outer 84 surfaces and a plurality of bosses 86 extending inwardly from the inner surface 82. In the illustrative embodiment, blade iron 74 includes two of the bosses 86, although three or more may be used within the scope of the present invention. Each boss 86 defines a clearance hole 88 which is effective for receiving a fastener, such as one of the bolts 90 shown in FIG. 3, for the purpose of fastening the base 76 to the sidewall 68 of the rotatable fan housing 62, such that base 76 is mounted to the radially outwardly facing surface 72 of sidewall 68. The outer surface 84 of base 76 includes a pair of countersinks 92 which are effective for receiving the head of bolts 90 so that they may be substantially flush with the outer surface 84 when installed. Each of the bolts 90 may be secured by a conventional fastener, such as a nut 94 disposed on the inner surface 70 of the sidewall 68 of the rotatable fan housing 62, as shown in FIG. 4.

Figure 5:
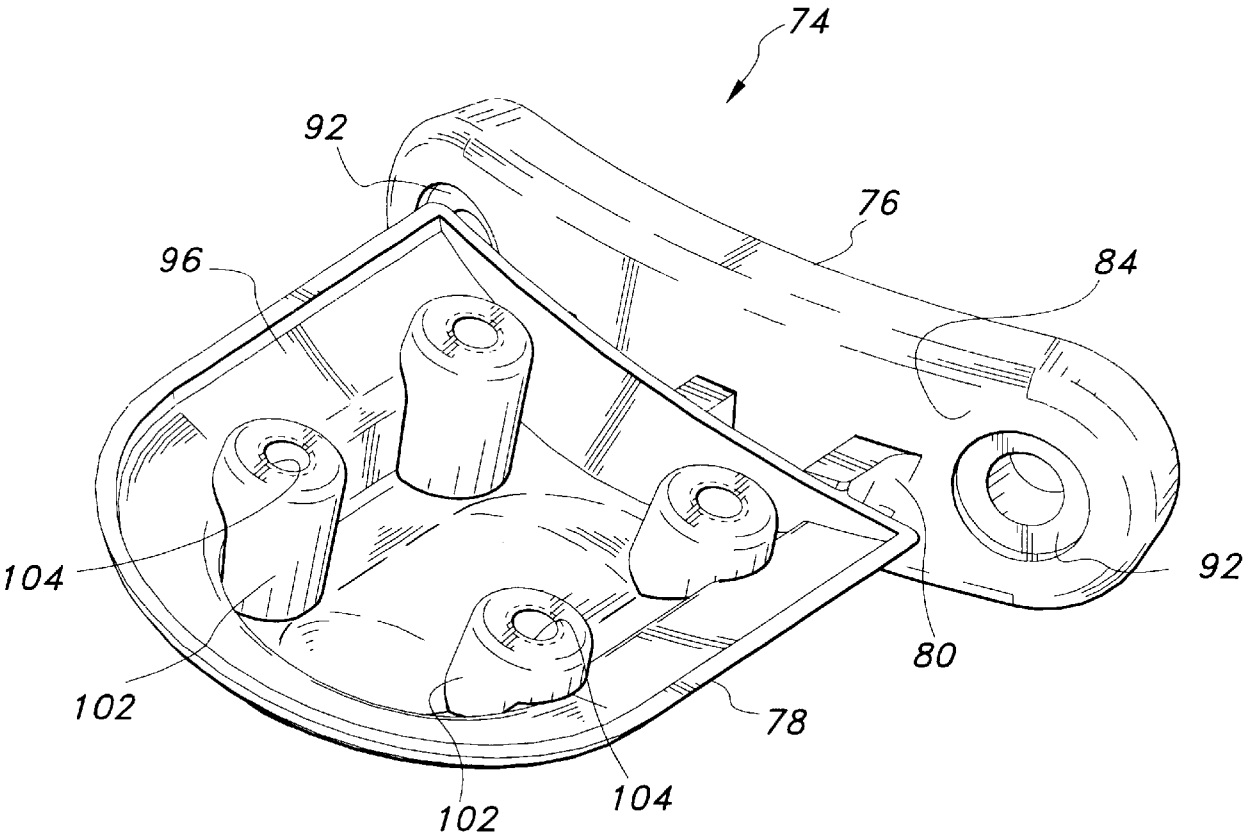
FIG. 5 is an enlarged perspective view of one of the blade irons included in the ceiling fan according to the present invention.
Figure 6:
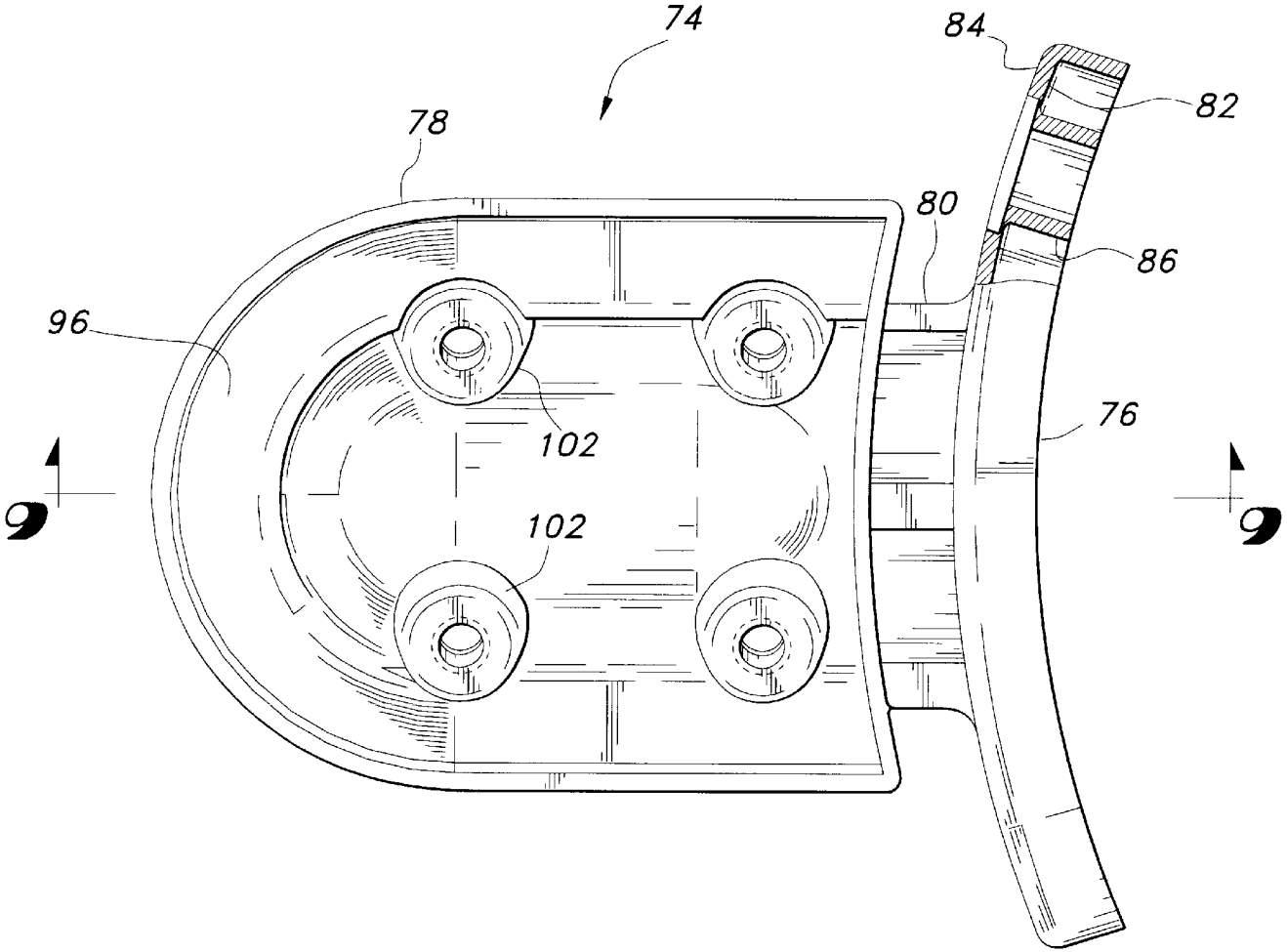
FIG. 6 is a top plan view of the blade iron shown in FIG. 5.
Figure 7:
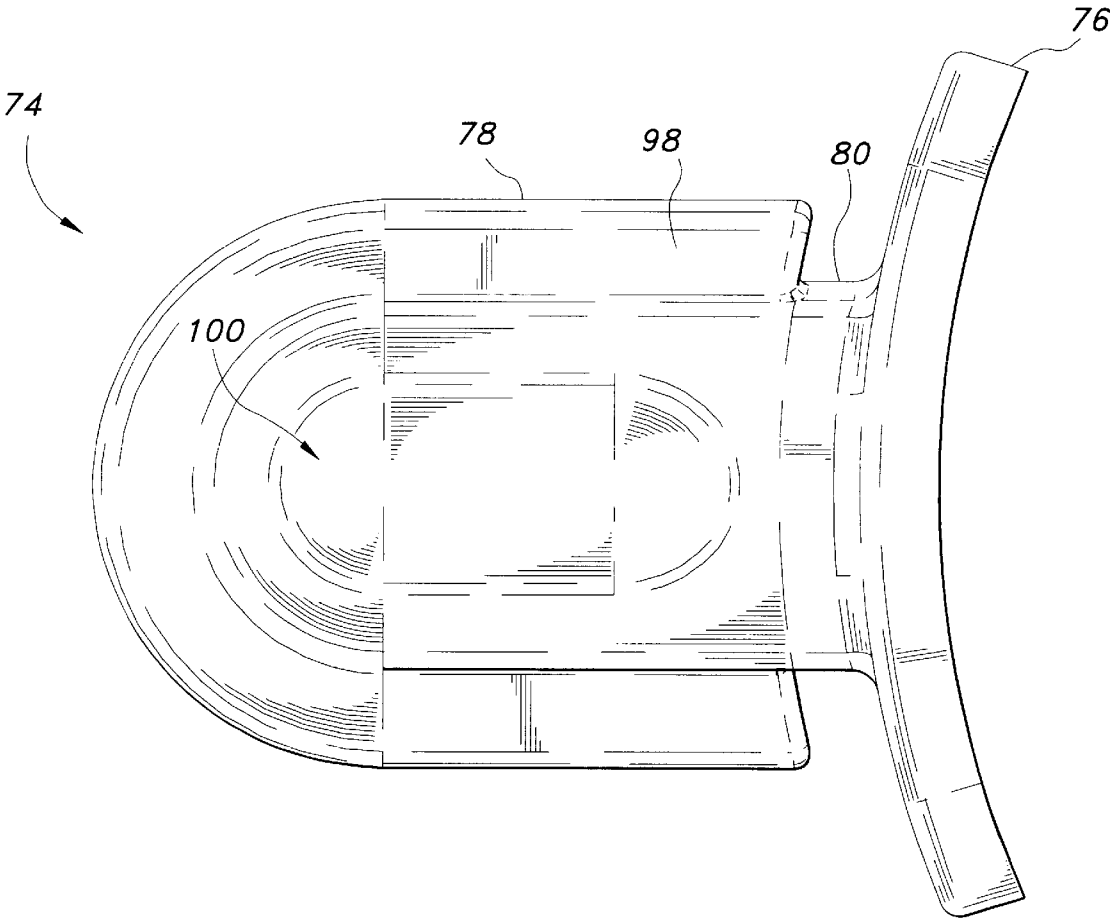
FIG. 7 is a bottom plan view of the blade iron shown in FIGS. 5 and 6.
Figure 8:
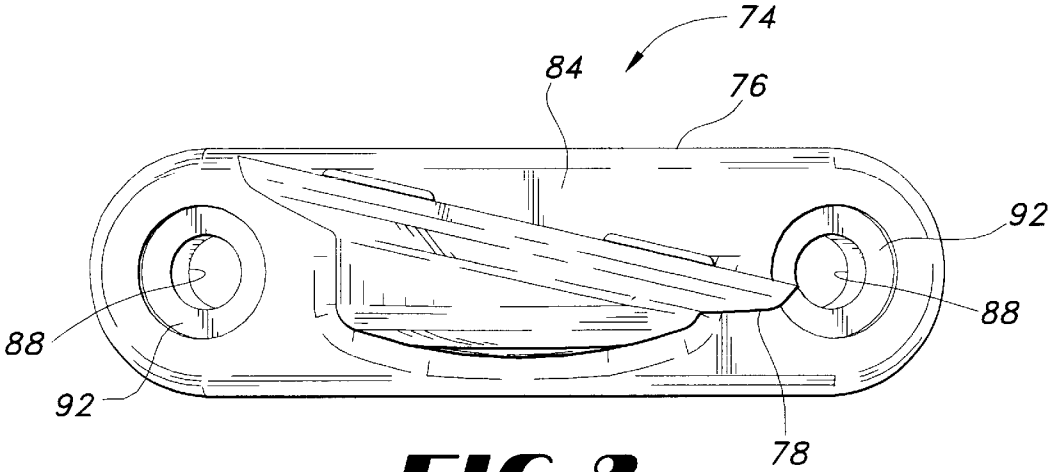
FIG. 8 is an end view of the blade iron shown in FIGS. 5–7.
Figure 9:
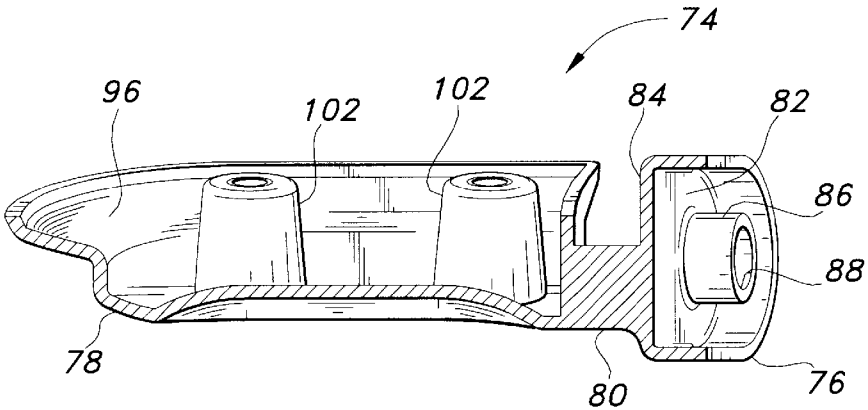
FIG. 9 is a cross-sectional view of the blade iron shown in FIGS. 5–8.

The blade supporting portion 78 of blade iron 74 includes upper 96 and lower 98 surfaces, and has a distinctive spade-like shape as best seen in FIGS. 5–7. The lower surface 98 includes a centrally disposed, oval-shaped depression 100 which contributes to the unique design and aesthetically pleasing appearance of blade irons 74. In other embodiments, the blade supporting portion 78 of blade iron 74 may have a wide variety of other shapes and configurations, as well as ornamental designs, consistent with the overall design of the particular ceiling fan.

As best seen in FIG. 5, the upper surface 96 of the blade supporting portion 78 has a "dished-out", concave shape. The blade supporting portion 78 includes a plurality of bosses 102 which are integral with and extend upwardly from the upper surface 96 of the blade supporting portion 78. Each of the bosses 102 include internal threads 104 which are effective for receiving a fastener used to attach one of the blades 16 to the blade supporting portion 78 of the corresponding blade iron 74. Each of the blades 16 includes a radially inner end 106 and a radially outer end 108 with the radially inner end 106 being supported by and attached to the blade supporting portion 78 of one of the blade irons 74. More particularly, the radially inner end 106 of each blade 16 is fastened to the blade supporting portion 78 of one of the blade irons 74 by a plurality of conventional fasteners, such as screws 110 (one shown in FIG. 4) which pass through apertures formed in the inner end 106 of each blade 16 and are threaded into one of the bosses 102 of the blade supporting portion 78 of one of the blade irons 74, thereby securing each fan blade 16 to one of the blade irons 74 so that the fan blades 16 and blade irons 74 rotate with the rotatable fan housing 62.

Ceiling fan 10 further includes a switch housing 112 which is attached to a lower end of the stator shaft 42 and contains electrical wires 114 which are connected at an upper end to the source of electrical power in the structure in which fan 10 is suspended, and are routed downward through the hollow canopy 20, the hollow downrod 26 and the hollow stator shaft 42 to motor 14. Wires 114 are then routed downward through the lower end of the stator shaft 42 to the interior of switch housing 112. Wires 114 may then be connected to various switches, as subsequently discussed for controlling the operation of fan 10.

In the illustrative embodiment, ceiling fan 10 includes a light fixture 116 which is disposed below the rotatable fan housing 62 and is secured to switch housing 112. However, it should be understood that the use of the light fixture 116 is optional and that in other embodiments the ceiling fan according to the present invention may not include a light fixture. Additionally, a wide variety of light fixtures may be used which have shapes and ornamental features different from those of fixture 116. Light fixture 116 includes a somewhat bell-shaped shade 118 having an upper portion 119 and a lower portion 120 which are attached to one another by a plurality of conventional fasteners such as bolts 121 (one shown). The lower portion 120 of shade 118 is attached to switch housing 112 by a plurality of fasteners such as screws 113 (one shown). The light fixture 116 also includes a base 122 which is attached to the lower portion 120 of shade 118 by a plurality of conventional fasteners such as screws 123 and the associated threaded inserts. Light fixture 116 further includes a light emitting globe 124 which is removably secured to and retained in position by the base 122. Globe 124 may be secured to base 122 in a conventional manner, for instance with a helical thread formed on globe 124 and a retention feature on base 122 which engages the helical thread. The particular means for securing globe 124 to base 122 do not form a part of the present invention. The light fixture 116 further includes a light bulb 126, which comprises a halogen bulb in the illustrative embodiment, which is secured to a bracket 128 mounted to the base 122. As shown in FIG. 4, the ceiling fan 10 includes switches 130 and 132, which are electrically coupled to selected ones of the wires 114 in a manner not shown and are used to control power to the light bulb 126 and the rotational speed of motor 14 respectively. The ceiling fan 10 may further include an additional switch (not shown) to control the rotational direction of motor 14.

In operation, electrical power is provided from the structure in which ceiling fan 10 is suspended to motor 14 via wires 114, causing the rotating portion of motor 14 to rotate in the desired direction at the desired speed. The rotatable fan housing 62, which is attached to the lower end cap 36 rotates with the rotating portion of the motor. Blade irons 74 and fan blades 16 also rotate with the rotating portion of the motor since the blade irons 74 are attached to the rotatable fan housing 62, thereby providing a supplemental means of conditioning the air within the structure from which ceiling fan 10 is suspended.

The configuration of the ceiling fan of the present invention provides several advantages relative to conventional ceiling fans. More particularly, since the included blade irons 74 are fastened to the substantially cylindrical sidewall 68 of the rotatable fan housing, various advantages are achieved which are associated with the manufacture, shipment, assembly and operation of the ceiling fan 10. Since the blade irons 74 are mounted directly to a side surface of the rotatable fan housing 62, the blade irons 74 may be smaller than those often used with conventional ceiling fans which are mounted to a bottom portion of the motor and are "looped" in an upward arc to achieve the desired position of the blade iron. Accordingly, blade irons 74 may be cheaper, lighter and have a longer service life due to reduced chance of fatigue, as compared to blade irons which are often used with conventional ceiling fans. Additionally, it is believed that the simplified geometry and mounting location of blade irons 74 will result in reduced chance of ceiling fan wobble during operation of fan 10. As may be appreciated by a review of the various figures included herein, an end consumer has an unobstructed access to the sidewall 68 of the rotatable fan housing 62 which simplifies the installation of blade irons 74 as compared to those used on many existing fans where the blade irons are mounted to a bottom portion of the electric motor for instance. The assembly required by the end consumer is further simplified, and the overall quantity of parts is reduced, by the use of vibration isolation grommets 67 which are disposed between motor 14 and rotatable fan housing 62 and are installed by the manufacturer, as compared to the use of vibration isolators in conventional ceiling fans in conjunction with the fasteners used to attach the blades to the blade irons, which are typically installed by the end consumer. Furthermore, the mounting arrangement permits the particular design of the illustrative ceiling fan 10, which could not be achieved with blade irons mounted to a bottom portion of the motor 14. Additionally, the attachment of the rotatable fan housing 62 to the electric motor 14 via a plurality of circumferentially spaced fasteners 66 provides a more rigid structure as compared to conventional ceiling fans employing only a stationary fan housing secured to the means for suspending the ceiling fan. This in turn allows a simplification of the package used to ship the fan in a disassembled condition. For instance, with conventional fans it is common to include rubber stabilizers under the relatively heavy motor to prevent damage during shipment, which is not required with the fan of the present invention.

While the foregoing description has set forth the preferred embodiments of the present invention in particular detail, it must be understood that numerous modifications, substitutions and changes can be undertaken without departing from the true spirit and scope of the present invention as defined by the ensuing claims. The invention is therefore not limited to specific preferred embodiments as described, but is only limited as defined by the following claims.

What is claimed is:

1. A ceiling fan comprising:

means for suspending said ceiling fan from a ceiling of a structure;

an electric motor coupled to said suspending means;

a rotatable housing mounted about the periphery of said electric motor, said rotatable housing having a radially outwardly facing surface;

a plurality of blade irons, each being mounted to and protruding outwardly from said radially outwardly facing surface of said rotatable housing;

a plurality of fan blades, each having a radially outer end and a radially inner end, said radially inner end of each of said fan blades being supported by one of said blade irons.

2. The ceiling fan as recited in claim 1, wherein:

each of said blade irons include a circumferentially extending base and a radially outwardly extending blade supporting portion;

said base of each of said blade irons is mounted to said radially outwardly facing surface of said rotatable housing;

said radially inner end of each of said fan blades is supported by said radially outwardly extending blade supporting portion of one of said blade irons.

3. The ceiling fan as recited in claim 2, wherein:

said rotatable housing includes a substantially cylindrical sidewall which includes said radially outwardly facing surface;

said circumferentially extending base of each of said blade irons is fastened to said substantially cylindrical sidewall of said rotatable housing.

4. The ceiling fan as recited in claim 1, further comprising a plurality of resilient grommets having an upper portion disposed between said electric motor and said rotatable housing.

5. A ceiling fan comprising:

means for suspending said ceiling fan from a ceiling of a structure;

an electric motor having a rotating portion and a stationary stator, said stator including a stator shaft connected to said means for suspending said ceiling fan;

a rotatable fan housing disposed in surrounding relationship with said electric motor, said rotatable fan housing being connected to said rotating portion of said electric motor, said rotatable fan housing including a radially outwardly facing surface;

a plurality of blade irons, each being mounted to and protruding outwardly from said radially outwardly facing surface of said rotatable fan housing;

a plurality of fan blades, each having a radially outer end and a radially inner end, said radially inner end of said fan blades being supported by one of said blade irons.

6. The ceiling fan as recited in claim 5, wherein:

each of said blade irons include a circumferentially extending base and a radially outwardly extending blade supporting portion;

said base of each of said blade irons is mounted to said radially outwardly facing surface of said rotatable fan housing;

said radially inner end of each of said fan blades is supported by said radially outwardly extending blade supporting portion of one of said blade irons.

7. The ceiling fan as recited in claim 6, wherein:

said rotatable housing includes a substantially cylindrical sidewall which includes said radially outwardly facing surface;

said circumferentially extending base of each of said blade irons is fastened to said substantially cylindrical sidewall of said rotatable fan housing.

8. The ceiling fan as recited in claim 5, wherein:

said electric motor comprises an inside-out electric motor wherein said rotor is disposed radially outwardly of said stator.

9. The ceiling fan as recited in claim 8, wherein:

said rotating portion of said inside-out electric motor includes a rotor, an upper end cap, and a lower end cap, said upper and lower end caps being attached to said rotor;

said rotatable fan housing is attached to said lower end cap of said rotating portion of said electric motor.

10. The ceiling fan as recited in claim 6, wherein:

said radially inner end of each of said fan blades is fastened to said radially outwardly extending blade supporting portion of one of said blade irons.

11. The ceiling fan as recited in claim 10, wherein:

said radially outwardly extending blade supporting portion of each of said blade irons includes a plurality of internally threaded bosses for the purpose of fastening said radially inner ends of said blades to said radially outwardly extending blade supporting portion of one of said blade irons.

12. The ceiling fan as recited in claim 6, wherein:

said base and said radially outwardly extending blade supporting portion, of each of said blade irons, are made as an integral casting.

13. The ceiling fan as recited in claim 5, further comprising:

a stationary fan housing attached to said means for suspending said ceiling fan.

14. The ceiling fan as recited in claim 13, wherein:

said means for suspending said ceiling fan includes a bracket which is mountable to the ceiling of the structure, a canopy attached to said bracket and having a seat, a downrod, an adaptor secured to a lower end of said downrod, and a ball secured to an upper end of said downrod and disposed within said seat of said canopy.

15. The ceiling fan as recited in claim 14, wherein:

said adaptor includes a radially extending flange portion and upper and lower substantially cylindrical portions;

said stationary fan housing is attached to said flange portion of said adaptor;

said upper substantially cylindrical portion of said adaptor is secured to said lower end of downrod; and said lower substantially cylindrical portion of said adaptor is secured to said stator shaft.

16. The ceiling fan as recited in claim 9, further comprising:

a plurality of resilient grommets having an upper portion disposed between said electric motor and said rotatable fan housing.

* * * * *